US010443802B2

(12) United States Patent
Tsai

(10) Patent No.: US 10,443,802 B2
(45) Date of Patent: Oct. 15, 2019

(54) PROJECTION FILM AND PROJECTION DEVICE

(71) Applicant: Young Optics Inc., Hsinchu (TW)

(72) Inventor: Wei-Hung Tsai, Hsinchu (TW)

(73) Assignee: YOUNG OPTICS INC., Hsinchu (TW)

( * ) Notice: Subject to any disclaimer, the term of this patent is extended or adjusted under 35 U.S.C. 154(b) by 0 days.

(21) Appl. No.: 16/107,239

(22) Filed: Aug. 21, 2018

(65) Prior Publication Data

US 2019/0063711 A1 Feb. 28, 2019

(30) Foreign Application Priority Data

Aug. 25, 2017 (TW) ..... 106129060 A

(51) Int. Cl.

| | |
|---|---|
| ***F21S 41/20*** | (2018.01) |
| *F21S 41/25* | (2018.01) |
| *F21W 102/40* | (2018.01) |
| *F21S 45/47* | (2018.01) |
| *F21Y 115/10* | (2016.01) |
| *F21S 41/141* | (2018.01) |

(52) U.S. Cl.

CPC ..... *F21S 41/285* (2018.01); *F21S 41/141* (2018.01); *F21S 41/25* (2018.01); *F21S 45/47* (2018.01); *F21W 2102/40* (2018.01); *F21Y 2115/10* (2016.08)

(58) Field of Classification Search

CPC ..... F21S 41/285; F21S 41/141; F21S 45/47; F21S 41/25; F21W 2102/40; F21Y 2115/10

See application file for complete search history.

(56) References Cited

U.S. PATENT DOCUMENTS

| | | | | |
|---|---|---|---|---|
| 8,599,483 | B1 | 12/2013 | Weber et al. | |
| 9,417,514 | B2 | 8/2016 | Liu et al. | |
| 2010/0007860 | A1* | 1/2010 | Ueda | G02B 27/1046 353/81 |
| 2011/0193125 | A1* | 8/2011 | Ushiro | B32B 7/02 257/98 |
| 2015/0077966 | A1* | 3/2015 | Bessho | G02B 5/0242 362/19 |
| 2019/0072252 | A1* | 3/2019 | Moser | F21V 11/186 |

FOREIGN PATENT DOCUMENTS

TW 201337442 9/2013

* cited by examiner

*Primary Examiner* — Kevin Quarterman
(74) *Attorney, Agent, or Firm* — WPAT, PC

(57) ABSTRACT

A projection film and a projection device are provided. The projection film includes a pattern layer, a first light-transmission layer, a second light-transmission layer and a plurality of light-transmission particles. The pattern layer includes a light-transmission portion and a non-light-transmission portion. The first light-transmission layer is disposed below the pattern layer. The second light-transmission layer is disposed below the first light-transmission layer. The light-transmission particles are disposed between the first light-transmission layer and the second light-transmission layer. The impurity generated by the light-transmission particles will be reduced by utilizing a second light-transmission layer having a refractive index close to the refractive index of the light-transmission particles.

20 Claims, 8 Drawing Sheets

161B

162B

PROJECTION FILM AND PROJECTION DEVICE

TECHNICAL FIELD

The present invention relates to a projection film and a projection device, and more particularly to a projection film and a projection device having a higher resolution and being applicable to a vehicle's projection.

BACKGROUND

Please refer to FIGS. 1A and 1B. FIG. 1A is a schematic illustration of a conventional projection film. FIG. 1B is a schematic structural view of a conventional projection film. In order to prevent the overlapping films from being mutually adhered to each other and not easy to be separated due to vacuum or static electricity and other reasons, both sides of the projection film are provided with a gelatin layer having a thickness of micron (um) level. The surface of the gelatin layer is provided with a plurality of micron-level light-transmission particles (e.g., glass) so that space can be reserved between the overlapping projection films for reducing the effect of vacuum or electrostatic attrition.

Both sides of the projection film are provided with a pattern layer which is relatively non-light-transmissive. A light-transmission portion and non-light-transmission portion are formed on the pattern layer by an exposure pattern process. When a specific portion on a surface of the pattern layer is removed, the light-transmission particles on the surface are also removed without affecting the passage of light. But the light-transmission particles on the other surface still exist.

For example, as shown in FIG. 1B, the conventional projection film 3 includes, in order from the light exit surface to the light entrance surface thereof, a protective layer 3A, a pattern layer 3B, an undercoat layer 3C, a substrate 3D, an antistatic layer 3E and a back coat layer 3F. The surface of the protective layer 3A facing the light exit direction Dout is provided with a plurality of scattered light-transmission particles M. In addition, the surface of the back coat layer 3F facing the light entrance direction Din is also provided with a plurality of light-transmission particles M arranged in a scattered or non-aligned manner.

When the conventional projection film 3 is applied to a projector, since the image is magnified by a high magnification, the pattern is also projected and enlarged to an image with, for example, contract color such being constituted by a black non-light-transmission region and a white light-transmission region according to the relationship between light-transmission portion and the non-light-transmission portion. In addition, the light-transmission particles M may generate impurity on the light-transmission portion as illustrated in FIG. 1A, thereby affecting of the quality of the projection. Therefore, how to remove the projection impurity is an important requirement.

SUMMARY

Other objectives and advantages of the present invention will become apparent from the technical features disclosed in the embodiments of the present invention.

According to one aspect of the present invention, a projection film is provided. The structure of the projection film sequentially includes a pattern layer, a first light-transmission layer, a plurality of light-transmission particles and a second light-transmission layer. The pattern layer includes a light-transmission portion and a non-light-transmission portion. The light-transmission particles are disposed between the first light-transmission layer and the second light-transmission layer. The refractive index of the second light-transmission layer is n1 and the refractive index of the light-transmission particles is n2. When the ratio of n1 to n2 is located between 0.7 and 1.3, the impurity generated by the light-transmission particles will be reduced by utilizing a second light-transmission layer having a refractive index close to the refractive index of the light-transmission particles.

According to another aspect of the present invention, a projection film is provided. The projection film sequentially includes a first light-transmission material layer, a plurality of scattered light-transmission particles, a second light-transmission material layer and a pattern layer. The light-transmission particles are disposed between the first light-transmission material layer and the second light-transmission material layer in a scatter manner. The refractive index of the first light-transmission material layer is between 1.3 and 1.6. The impurity generated by the light-transmission particles when the light passes through the projection film will be slowed down by covering the surface of the light-transmitting particles with a light-transmission adhesive layer having a specific refractive index.

According to another aspect of the present invention, a projection device is provided. The projection device includes a light source, a fixed pattern light valve and a projection lens. The light source is for outputting an illumination light. The illumination light is converted to an image light by the light valve and output via the projection lens. The light valve sequentially includes a first light-transmission material layer, a second light-transmission material layer, a plurality of light-transmission particles and a pattern layer. The light-transmission particles are disposed between the first light-transmission material layer and the second light-transmission material layer. The refractive index of the light-transmission adhesive layer is between 1.3 and 1.6. The projection lens is disposed on the optical path of the illumination light after passing through the projection film. The impurity generated by the light-transmission particles will be reduced by utilizing a second light-transmission layer having a refractive index close to the refractive index of the light-transmission particles.

BRIEF DESCRIPTION OF THE DRAWINGS

The present disclosure will become more readily apparent to those ordinarily skilled in the art after reviewing the following detailed description and accompanying drawings, in which.

DETAILED DESCRIPTION OF PREFERRED EMBODIMENTS

The present disclosure will now be described more specifically with reference to the following embodiments. It is to be noted that the following descriptions of preferred embodiments of this disclosure are presented herein for purpose of illustration and description only. It is not intended to be exhaustive or to be limited to the precise form disclosed.

The following terms, such as "above", "under", etc., which are mentioned in the present invention, are merely illustrative of the relative positional relationship between two elements and are not intended to limit the using direction of the present invention.

Figure 1A:
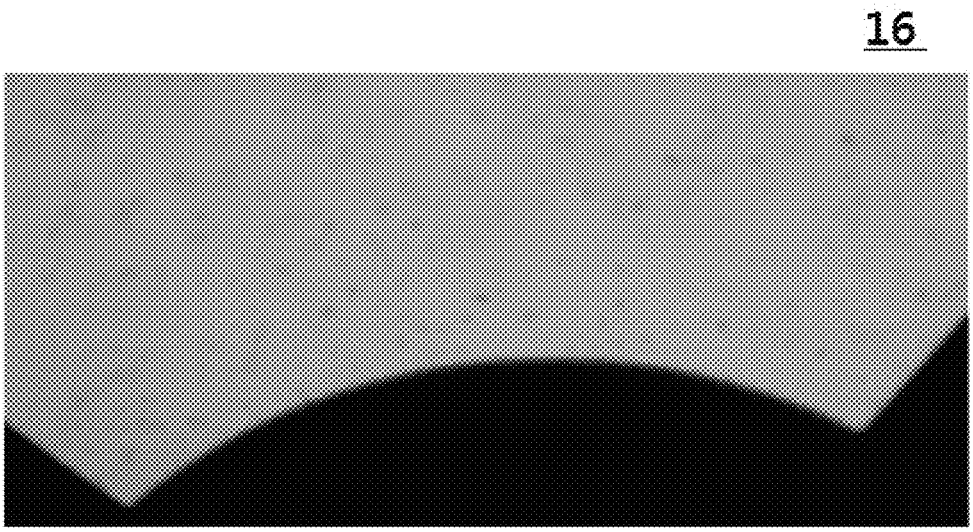
FIG. 1A (Prior Art)
FIG. 1A is a schematic illustration of a conventional projection film.
Figure 1B:
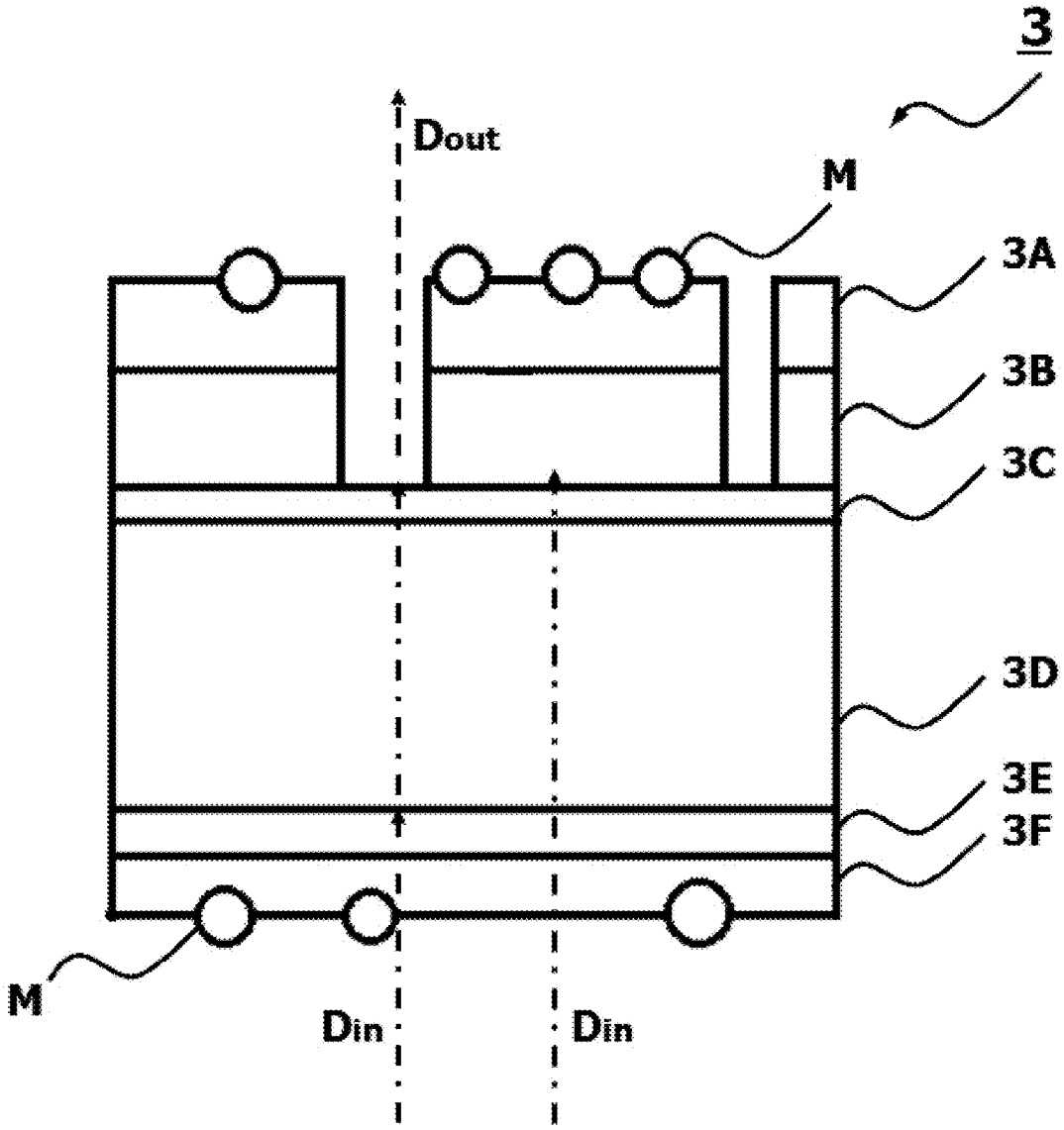
FIG. 1B (Prior Art)
FIG. 1B is a schematic structural view of a conventional projection film.
Figure 2:
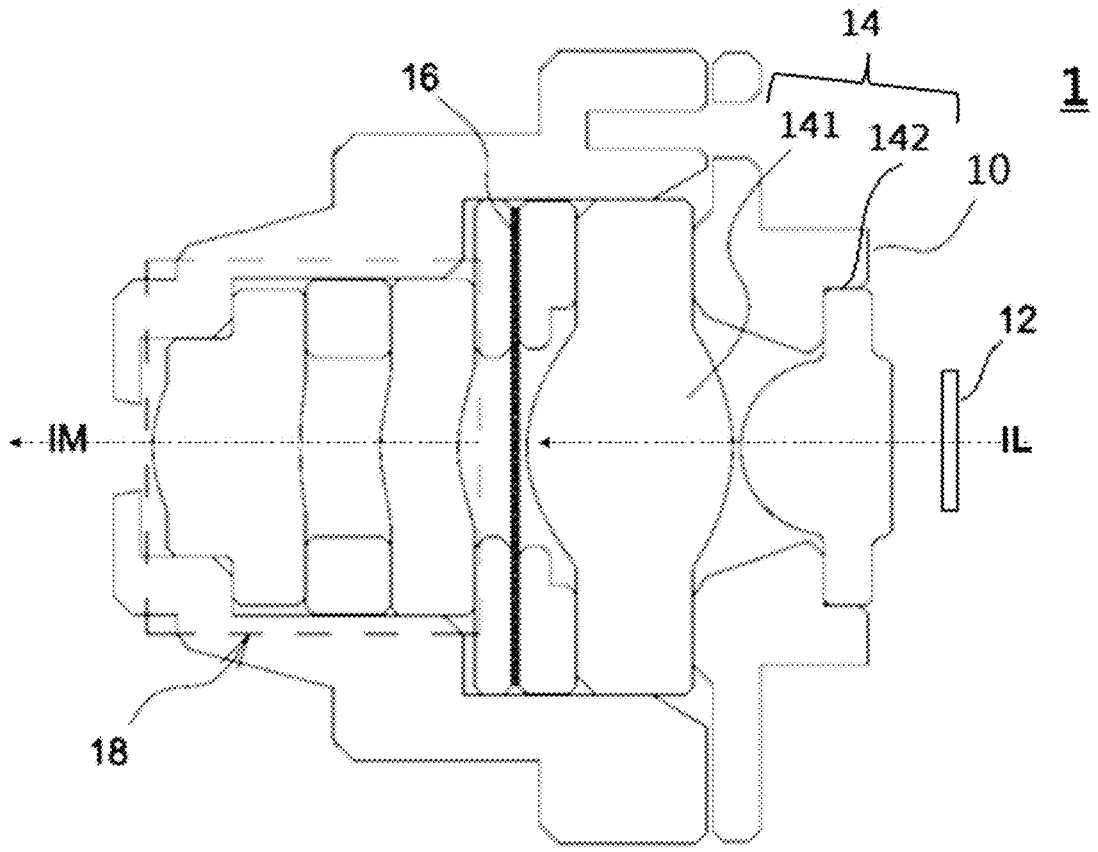
FIG. 2 is a schematic view of a projection device in accordance with an embodiment of the present invention.

Referring to FIG. 2, which is a schematic view of a projection device in accordance with an embodiment of the present invention. The projection device 1 may be mounted, for example, on the lower portion or nearby a door of a vehicle, such as an automobile, and project the formed image outside the vehicle, thereby constituting a welcome lamp or puddle lamp for a vehicle or other applications.

In the present embodiment, the projection device 1 has a casing 10, and the projection device 1 can be fixed to a vehicle thereby. In the casing 10, a light source 12, a focusing lens set 14, a light valve 16 and a projection lens 18 are sequentially disposed along a light path, or called the traveling path of light. In application, the light source 12 generates an illumination light IL, and the illumination light IL is converged on the light valve 16 by the focusing lens set 14. The light valve 16 provides at least one predetermined image, and the predetermined image is converted or modulated into an image light IM corresponding to the predetermined image after the illumination light IL passes through the light valve 16. The projection lens 18 receives and projects the image light IM to form the predetermined image on an imaging surface.

The light source 12 may be various kinds of light emitting element or device such as a light emitting diode, a laser diode or a mercury lamp for a projection device. In the present embodiment, the light source 12 includes a encapsulated white colored light emitting diode (LED) module which is connected to a heat fin set, having a plurality of heat fins formed on a substrate, so as to produce the white illumination light IL.

Further, the focusing lens set 14 may be comprises an optical lens group, wherein the optical lens group has one or more lenses with refractive power, the total refractive power of the optical lens group is positive, and the optical lens group can be utilized for adjusting a light traveling angle of a light beam. In the present embodiment, the focusing lens set 14 includes two convex lenses 141, 142 having positive refractive power respectively and can be utilized to reduce the angle of divergence of the light beam. The convex lenses 141, 142 are a spherical lens and an aspherical lens, respectively.

Further, the projection lens 18 includes a projection lens group. The projection lens group includes at least one lens having a negative refractive power. The lens may be a singlet lens, a cemented doublet lens or a cemented triplet lens. In the present embodiment, the projection lens 18 is disposed at an optical path of the illumination light IL after passing through a projection film (light valve 16). The projection lens 18 includes two aspherical lenses having a positive refractive power for adjusting the light pattern of the entering light or improving the various distortions of the entering light.

Figure 3A:
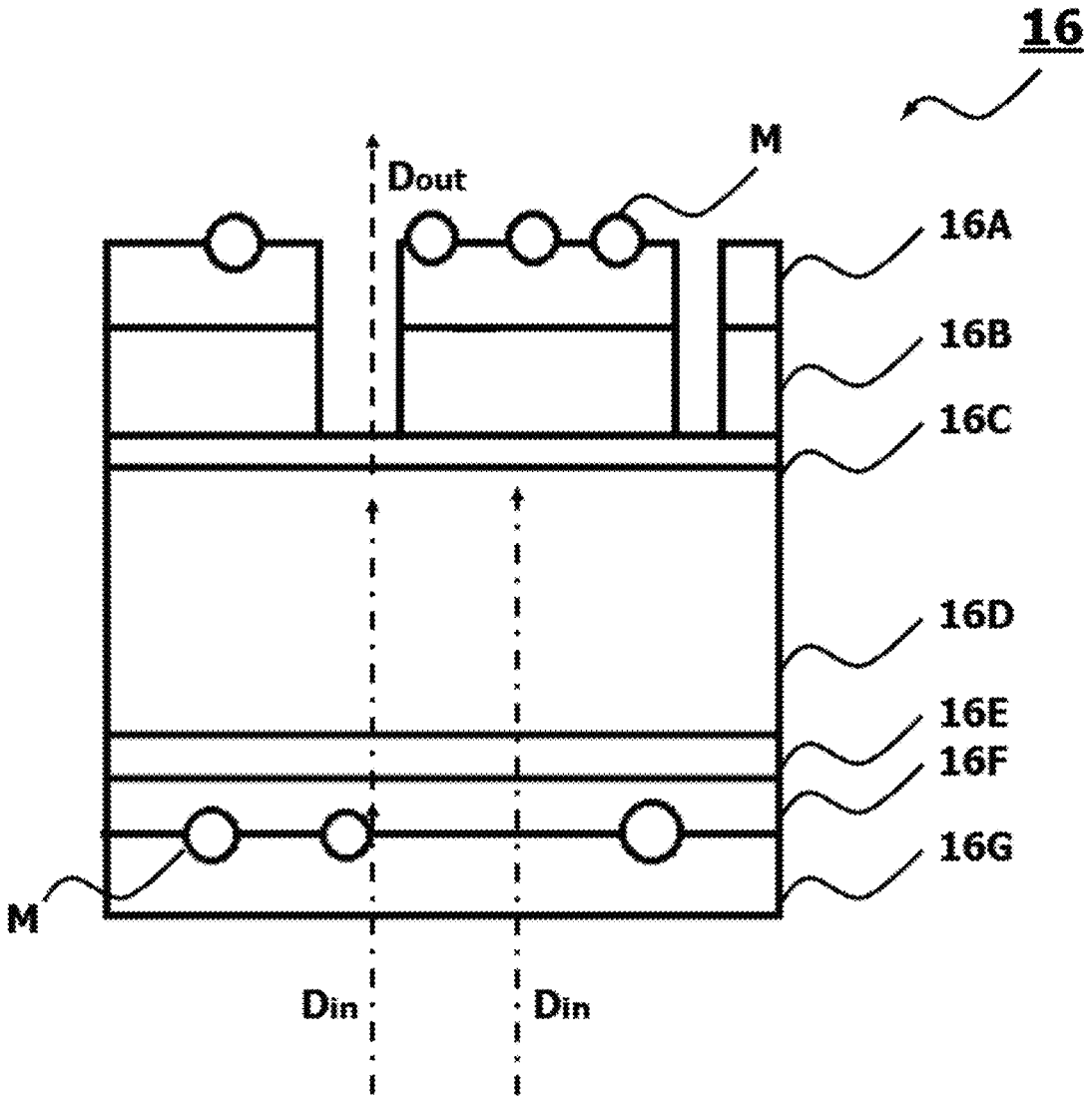
FIG. 3A is a schematic structural view of a projection device in accordance with an embodiment of the present invention.

The light valve 16 has been widely used in the industry and refers to an optical element that converts an illumination light into an image light. Referring to FIG. 3A, which is a schematic view of a light valve in accordance with an embodiment. In the present embodiment, the light valve 16 is an invariable image light valve with a predetermined invariable image formed thereon. The projection film 16 includes, in order from the light exit surface to the light entrance surface thereof, a light-transmission layer 16A, a pattern layer 16B, and light-transmission layers 16C, 16D, 16E, 16F and 16G. In the present embodiment, except for the pattern layer 16B, each of the light-transmission layers 16A, 16C, 16D, 16E, 16F and 16G is a light-transmission material layer formed of light-transmission materials such as glass, plastic, resin or others. The light-transmission layer 16A is provided with a plurality of light-transmission particles M scattered around the surface facing the light exit direction Dout. In addition, the light-transmission layer 16F is also provided with a plurality of light-transmission particles M scattered around the surface facing the light entrance direction Din. In the present embodiment, the light-transmission layer 16G is disposed on the light-transmission layer 16F on the light entrance surface of the projection film 16, and the light-transmission layer 16G covers the light-transmission particles M and at least a part of the light-transmission layer 16F.

In the present embodiment, the light-transmission layer 16A is used as a protective layer. The light-transmission layer 16A is coated on the surface of the pattern layer 16B, has a thickness of about 1 to 2 um. The light transmission layer is formed of gelatin material.

In the present embodiment, the pattern layer 16B is designed to have a single color gradation (black or white), but it can also have the grayscale adjustment by adjusting the proportion of the coverage of the light-transmission portion. In addition, when necessary, a variety of filter layers with different brightness and colors may be further disposed on the pattern layer 16B to adjust the color and grayscale of the light passing through the pattern layer 16B.

In the present embodiment, the light-transmission layer 16C is utilized as an undercoat layer and may be utilized as a bonding layer or adhesion layer. The light-transmission layer 16C is mainly used for enhancing the adherence of the pattern layer 16B to the light-transmission layer 16D so that the pattern layer 16B can be firmly fixed on the light-transmission layer 16D to prevent the pattern layer 16B from peeling off from the light-transmission layer 16D. The thickness of the light-transmission layer 16C is, for example, less than or equal to 1 um.

In the present embodiment, the light-transmission layer 16D can be used as a carrier of other material layers and have a thickness of about 175 um. The thickness of the light-transmission layer 16D can be adjusted to 50 to 200 um depending on the requirement of strength. In the present embodiment, the light-transmission layer 16D is formed of a polyester material. In other embodiments, the light-transmission layer 16D may be formed of glass, plastic, resin or other light-transmission materials.

In the present embodiment, the light-transmission layer 16E may be used as an anti-static layer. The light-transmission layer 16E is coated on the surface of the light-transmission layer 16D facing the light entrance surface of the projection film 16 and may have anti-static and anti-curling functions.

In the present embodiment, the light-transmission layer 16F is used as a back coat layer and its material is the same as that of the light-transmission layer 16A. In the present embodiment, both of the material of the light-transmission layer 16F and the material of the light-transmission layer 16A are gelatin. The light-transmission layer 16F has a thickness of about 2 to 3 um and can be used to fix the light-transmission particles M on the surface thereof facing the light entrance surface of the projection film 16.

In the present embodiment, the component of the light-transmission particles M is silica such as quartz glass having a refractive index of 1.458. The light-transmission particles M are at least partially transparent, and each light-transmission particle M is a spheroid having a diameter about 5 to 10 um. The light-transmission particles M have a light scattering property and therefore are also a kind of scattering particle. In another embodiment, the light-transmission particles M may be formed of other transparent materials such as silicone or resin and have different diameters (for example, from 1 to 200 um) and shapes.

The light-transmission layer 16G is mainly composed of light-transmission material such as glass, plastic, resin and the likes. The refractive index of the light-transmission layer 16G is close to that of the light-transmission particles M, thereby reducing the impurity formed by the refraction of the light-transmission particles M. In application, the light-transmission layer 16G may be a liquid, gelatinous or solid form, and preferably be the solid form. Or, the light-transmission layer 16G may be solid form which is solidified from the liquid or gelatinous form. In the present embodiment, the light-transmission layer 16G is a transparent optical tape having a refractive index of 1.47, that is, the light-transmission layer 16G is a light-transmission adhesive layer covering the light-transmission particles M and the light-transmission layer 16F. In other words, in the present embodiment, the refractive index of the light-transmission layer 16G is about 1% higher than the refractive index of the light-transmission particles M. When the light-transmission layer 16G covers the light-transmission particles M, the outline of the light-transmission layer 16G is slightly changed with the outer shape of the light-transmission particles M rather than being a flat surface.

Figure 3B:
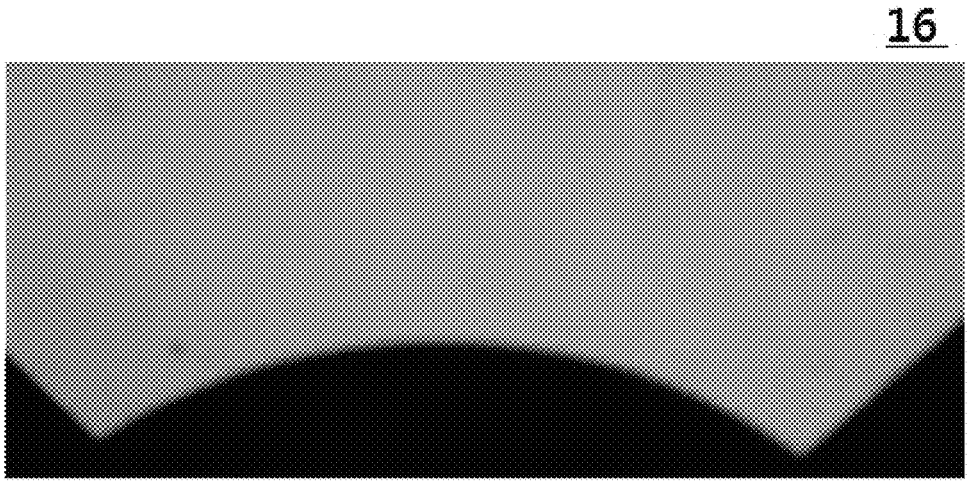
FIG. 3B is a schematic illustration of an improved projection film in accordance with an embodiment of the present invention.

In another embodiment, the light-transmission layer 16G may be formed of a UV-curable optical colloid or a thermosetting optical colloid or the like so that the light exit surface thereof may be a flat surface. In addition, in the present embodiment, the two outermost surfaces of the material layers in the projection film 16 are non-reflective surfaces and allow the light to pass therethrough and are substantially transparent. In the present embodiment, the refractive index of the light-transmission layer 16G is preferably between 1.2 and 2.0, and more preferably between 1.3 and 1.6. By covering the light-transmitting particles M with the light-transmitting layer 16G having a close refractive index, the impurity generated by the light-transmission particles M being irradiated by the backlight is significantly improved as shown in FIG. 3B. In the embodiment, the surfaces of the light-transmission particles M facing the light entrance surface of the projection film 16 are completely covered with the light-transmission layer 16G without penetrating and being exposed from the light-transmission layer 16G.

The difference between the refractive indexes of the light-transmission particles M and the light-transmission layer 16G is depending on the diameter and curvature of the light-transmission particles M. Herein it is assumed that the refractive index of the light-transmission layer 16G is n1, and the refractive index of the light-transmission particles M is n2. When n2 is closer to n1, the effect of eliminating the impurity generated by the light-transmission particles M may be better. When the relation $0.7 \leq n2/n1 \leq 1.3$ is satisfied, a basic effect of impurity elimination may be obtained. When the relation $0.8 \leq n2/n1 \leq 1.2$ is satisfied, an improved effect of impurity elimination may be obtained, with respect to the relation $0.7 \leq n2/n1 \leq 1.3$. When the relation $0.9 \leq n2/n1 \leq 1.1$ is satisfied, an improved effect of impurity elimination may be obtained, with respect to the relation $0.8 \leq n2/n1 \leq 1.2$. When the relation $0.95 \leq n2/n1 \leq 1.05$ is satisfied, an improved effect of impurity elimination may be obtained, with respect to the relation $0.9 \leq n2/n1 \leq 1.1$. When the relation $0.97 \leq n2/n1 \leq 1.03$ is satisfied, an improved effect of impurity elimination may be obtained, with respect to the relation $0.95 \leq n2/n1 \leq 1.05$. When the relation $0.985 \leq n2/n1 \leq 1.015$ is satisfied, an improved effect of impurity elimination may be obtained, with respect to the relation $0.97 \leq n2/n1 \leq 1.03$. That is, in the present invention, when the refractive index of the optical colloid is within ±30%, ±20%, ±30%, ±5%, ±3% and ±1.5% of the refractive index of the light-transmission particles M, the improvement of the effect of impurity elimination is further enhanced in order.

Referring to FIG. 3A, which is a schematic view of the constituent structure of the projection film 16 in accordance with an embodiment of the present invention from another aspect. The projection film 16 includes, in order from the light entrance surface to the light exit surface thereof, a first light-transmission material layer 16G (also referred to as a light-transmission layer in above embodiment), a plurality of light-transmission particles M, a second light-transmission material layer 16F (also referred to as a light-transmission layer in above embodiment) and a pattern layer 16B. The pattern layer 16B includes a light-transmission portion and a non-light-transmission portion, and a normal image layer having a grayscale or different color and contour may be used. The light-transmission particles M are disposed between the first light-transmission material layer 16G and the second light-transmission material layer 16F. By providing an optical material layer such as an optical adhesive or other light-transmission adhesive having a refractive index similar to that of the light-transmission particles M on the light-transmission particles M as the first light-transmission material layer 16G and covering the light-transmission particles M with the optical material layer, the impurity can be diluted. In the present embodiment, the light-transmission particles M are silicon dioxide (quartz) and have a diameter of about 5 to 10 um and a refractive index of 1.458, the second light-transmission layer 16F adopts an optical tape having a refractive index of 1.47, the refractive index of the second light-transmission layer 16F is 1.01 times the refractive index of the light-transmission particles M, and thus the impurity is diluted as shown in FIG. 3B. As described above, the pattern layer 16B includes a light-transmission portion and a non-light-transmission portion, so that the pattern can be projected and enlarged to an image with contract color such being constituted by a black non-light-transmission region and a white light-transmission region. The light transmissions of the light-transmission portion and the non-light-transmission portion are only relative, that is, the non-light-transmission portion does not mean that it is completely non-light-transmission but means that the light-transmission rate of the non-light-transmission portion is lower than that of the light-transmission portion. The light-transmission portion can be an empty portion which is not filled with any material.

In application, the light source 12 generates an illumination light IL, and the illumination light IL is converged on the projection film 16 by the focusing lens set 14. The illumination light IL is converted into an image light IM corresponding to a predetermined image after the illumination light IL passes through the projection film 16. The projection lens 18 receives and projects the image light IM to form the predetermined image on an imaging surface.

Figure 4:
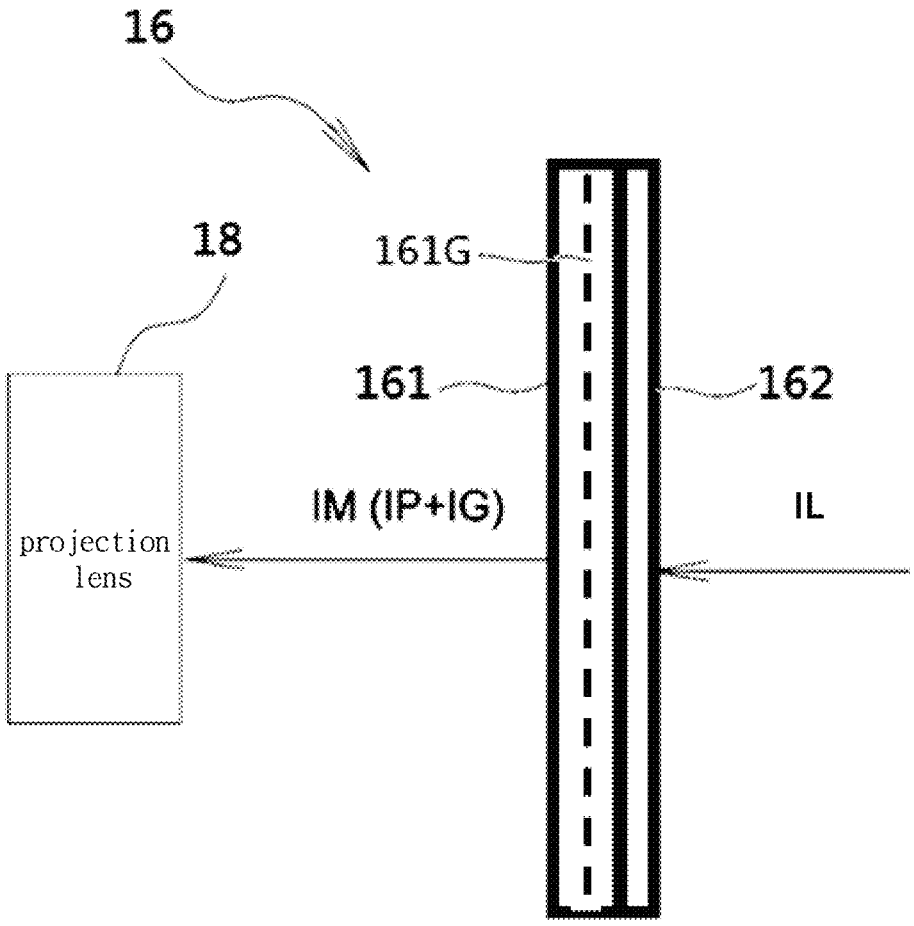
FIG. 4 is a schematic view of a portion of a projection film of a projection device in accordance with another embodiment of the present invention.

Referring to FIG. 4, which is a schematic view of a portion of a projection film in accordance with another embodiment of the present invention. As shown in FIG. 4, in the present embodiment, the light valve 16 includes a first projection film 161 and a second slide film 162. The structure of the first projection film 161 is substantially the same as the structure of the second projection film 162 except that the second projection film 162 does not have the light-transmission layer 161G as in the first projection film 161. In the present embodiment, the light-transmission layer 16G (FIG. 3A) of the first projection film 161 is in contact with the light-transmission layer 16F (back coat layer, FIG. 3A) of the second projection film 162 and the light-transmission particles M (FIG. 3A). In addition, the first projection film 161 and the light-transmission layer 16F (back coat layer) the second projection film 162 are disposed between the pattern layer 161B of the first projection film 161 and the pattern layer 162B of the second projection film 162, that is, the light entrance surface of the projection film 161 is opposite to the light entrance surface of the second projection film 162.

Figure 5A:
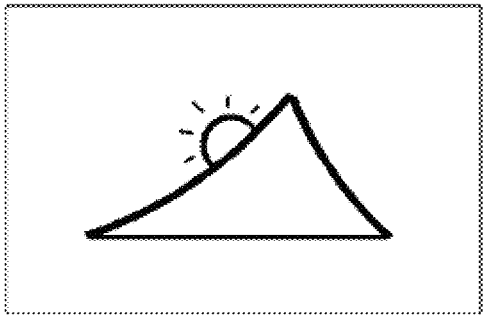
FIGS. 5A and 5B are schematic views combined projection films in a projection device in accordance with another embodiment of the present invention.
Figure 5B:
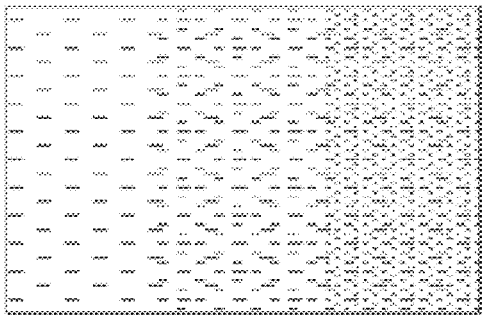

In the present embodiment, the patterns loaded on the pattern layer 16B and derived from the first projection film 161 and the second projection film 162 are different from each other. As shown in FIG. 5A, the pattern layer 161B of the first projection film 161 includes a contour image. As shown in FIG. 5B, the pattern layer 162B of the second projection film 162 includes a grayscale gradient image. The formation of the grayscale gradient images is not limited, for example, the grayscale gradient image may be formed by using the dot print to form a dot distribution having different densities or by using the film pattern to produce a different grayscale change. The contour image can be a black and white image or a color image and is not limited. The light passing through the contour image of the first projection film 161 can constitute the pattern outline of the predetermined projection image, and the light passing through the different regions in the grayscale gradient image of the second projection film 162 may produce only a bright and dark gradient change. The contour image of the first projection film 161 can convert the illumination light IL into a contour image light IP which does not have a grayscale gradient. The grayscale gradient image of the second projection film 162 can convert the illumination light IL into a gradient image light IG. Therefore, the projection film can provide the function of the light valve 16 so that the projection lens group 18 projects a predetermined image having grayscale change after receiving the contour image light IP and the gradient image light IG. In the present embodiment, the first projection film 161 and the second projection film 162 overlap with each other. In another embodiment, the first projection film 161 and the second projection film 162 do not overlap with each other and have a spacing therebetween, and the spacing may be, for example, greater than 0.1 mm.

As shown in FIG. 4, in the present embodiment, the first projection film 161 and the second projection film 162 are connected by the light-transmission layer 161G of the first projection film 161. The projection film 162 having a grayscale gradient image may be disposed in a defocused area outside the focus position of the projection lens group 18 to blur the image. The first projection film 161 having a contour image may be disposed at a focus position of the projection lens group 18 so that the pattern outline can be clearly imaged. For example, if the grayscale gradient image of the second projection film 162 is composed of printing dots of different distribution densities, by blurring the dots of the grayscale gradient image, it is not necessary to use the high resolution to manufacture the dot grayscale, and therefore, the working hours and costs are reduced, the moire generated by the dot imaging is avoided, and the grayscale change effect and visual taste are improved. Further, since the first projection film 161 having the contour image and the second projection film 162 having the grayscale gradient image are disposed separately from each other, the saw tooth at the edge of the projection image caused by the dots at the edge of the contour can be effectively improved. In addition, by using the film pattern to form a grayscale change, it will not be limited by the minimum line width and thus can form a thin contour to improve the image resolution. In addition to the aforementioned design of using two separated projection films, the pattern layers of the two projection films can also be integrated to a single projection film to achieve the corresponding effect. In addition, in the present embodiment, the illumination light IL sequentially passes through the protective layer of the second projection film 162, the pattern layer loaded with grayscale pattern, the light-transmission particles M, the light-transmission layer 161G of the first projection film 161, the light-transmission particles of the first projection film 161, the pattern layer loaded with contour pattern and then exits from a protective layer. The first projection film 161 and the second projection film 162 are considered to be a single projection film in the present design. In another embodiment, the structures of the first projection film 161 and the second projection film 162 may be the same and are disposed separated from each other.

The parameters listed in the above specific embodiments are illustrative only and are not intended to limit the present invention. While the disclosure has been described in terms of what is presently considered to be the most practical and preferred embodiments, it is to be understood that the disclosure needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A projection film, comprising:

a first light-transmission layer, having a refractive index of n1;

a second light-transmission layer, disposed above the first light-transmission layer;

a pattern layer, disposed above the second light-transmission layer, wherein the pattern layer comprises a light-transmission portion and a non-light-transmission portion; and a plurality of light-transmission particles, disposed between the first light-transmission layer and the second light-transmission layer, wherein a refractive index of the light-transmission particles is n2, wherein the projection film satisfies the following conditions of: $0.7 \leq n2/n1 \leq 1.3$.

2. The projection film according to claim 1, wherein the first light-transmission layer is a light-transmission adhesive layer, a diameter of the light-transmission particles is less than 50 um, and the projection film satisfies the following conditions of: $0.9 \leq n2/n1 \leq 1.1$.

3. The projection film according to claim 1, wherein the first light-transmission layer is a first light-transmission material layer, the second light-transmission layer is a second light-transmission material layer, and a refractive index of the first light-transmission material layer is between 1.3 and 1.6.

4. The projection film according to claim 3, wherein the light-transmission particles are formed of silicon dioxide, and the refractive index of the first light-transmission material layer is between 97% and 103% of the refractive index of the light-transmission particles.

5. The projection film according to claim 3, wherein a ratio of the refractive index of the light-transmission particles to the refractive index of the first light-transmission material layer is between 0.98 and 1.02.

6. A projection film, comprising:

a first light-transmission material layer;

a second light-transmission material layer, disposed above the first light-transmission material layer, wherein a plurality of light-transmission particles are disposed in a scatter manner between the first light-transmission material layer and the second light-transmission material layer; and a pattern layer, disposed above the second light-transmission material layer, wherein a refractive index of the first light-transmission material layer is between 1.3 and 1.6.

7. The projection film according to claim 6, wherein the light-transmission particles are formed of silicon dioxide, and the refractive index of the first light-transmission material layer is between 97% and 103% of the refractive index of the light-transmission particles.

8. The projection film according to claim 6, wherein a ratio of the refractive index of the light-transmission particles to the refractive index of the first light-transmission material layer is between 0.98 and 1.02.

9. A projection device applicable to a vehicle, the projection device comprising:

a light source, for outputting an illumination light;

a light valve, disposed on an optical path of the illumination light and comprising a first light-transmission material layer, a second light-transmission material layer, a plurality of light-transmission particles and a pattern layer, wherein the second light-transmission material layer is disposed above the first light-transmission material layer, the light-transmission particles are disposed between the first light-transmission material layer and the second light-transmission material layer, the pattern layer is disposed above the second light-transmission material layer, and a refractive index of the first light-transmission material layer is between 1.3 and 1.6; and a projection lens, disposed on the optical path of the illumination light after passing through the light valve.

10. The projection device according to claim 9, wherein the light-transmission particles are formed of silicon dioxide, and the refractive index of the first light-transmission material layer is between 97% and 103% of the refractive index of the light-transmission particles.

11. The projection device according to claim 9, wherein a ratio of the refractive index of the light-transmission particles to the refractive index of the first light-transmission material layer is between 0.98 and 1.02.

12. The projection device according to claim 9, wherein the light valve comprises:

a first projection film, comprising a first pattern layer, the first light-transmission material layer, the light-transmission particles and the second light-transmission material layer, wherein the light-transmission particles of the first projection film are disposed between the first light-transmission material layer and the second light-transmission material layer; and a second projection film, comprising a second pattern layer, a third light-transmission material layer and a plurality of light-transmission particles, wherein the light-transmission particles of the second projection film are disposed on a surface of the third light-transmission material layer, wherein the first projection film and the second projection film are provided between the light source and the projection lens, the first pattern layer corresponds to a grayscale pattern, and the second pattern layer corresponds to a contour pattern.

13. The projection device according to claim 12, wherein the second light-transmission material layer and the third light-transmission material layer are disposed between the first pattern layer and the second pattern layer, and the first light-transmission material layer contacts both the second light-transmission material layer and the third light-transmission material layer.

14. The projection device according to claim 13, wherein the first light-transmission material layer covers both the first projection film and the light-transmission particles of the second projection film.

15. The projection device according to claim 9, wherein the first light-transmission material layer is an optical tape, the second light-transmission material layer comprises gelatin, one of the light-transmission particles is a silicon dioxide material, and a ratio of the refractive index of the first light-transmission material layer to the refractive index of the light-transmission particles is between 0.98 and 1.02.

16. The projection device according to claim 9, wherein the light valve is a fixed image light valve, the projection device further comprises a housing, the projection lens is disposed in the housing, and the casing is fixed to the vehicle.

17. The projection device according to claim 9, wherein the projection device is a vehicle welcome lamp.

18. The projection device according to claim 9, wherein the light source comprises a white light emitting diode module.

19. The projection device according to claim 18, wherein the white light emitting diode module is encapsulated and connected to a heat fin set.

20. The projection device according to claim 9, further comprising a focusing lens set for converging the illumination light on the light valve.

* * * * *